US006739115B1

(12) United States Patent
Malini

(10) Patent No.: US 6,739,115 B1
(45) Date of Patent: May 25, 2004

(54) EQUIPMENT FOR WRAPPING GROUPS OF PRODUCTS IN PLASTIC FILM

(75) Inventor: Massimo Malini, Bologna (IT)

(73) Assignee: Aetna Group S.p.A., Rimini (IT)

( * ) Notice: Subject to any disclaimer, the term of this patent is extended or adjusted under 35 U.S.C. 154(b) by 0 days.

(21) Appl. No.: 10/355,457

(22) Filed: Jan. 31, 2003

(51) Int. Cl.[7] ..... B65B 11/00
(52) U.S. Cl. ..... 53/588; 53/210
(58) Field of Search ..... 53/209, 210, 557, 53/588, 589, 590, 441, 442, 465; 100/27

(56) References Cited

U.S. PATENT DOCUMENTS

| | | | | | |
|---|---|---|---|---|---|
| 3,540,187 | A | * | 11/1970 | Monaghan | 53/210 |
| 3,791,100 | A | * | 2/1974 | Monaghan | 53/210 |
| 4,706,444 | A | * | 11/1987 | Gambetti | 53/557 |
| 5,203,144 | A | * | 4/1993 | Gambetti | 53/210 |
| 5,203,146 | A | | 4/1993 | Gambetti | |
| 5,463,846 | A | * | 11/1995 | Gambetti | 53/210 |
| 5,619,843 | A | * | 4/1997 | Ganz | 53/557 |
| 6,128,888 | A | * | 10/2000 | Gambetti | 53/210 |
| 6,474,041 | B1 | * | 11/2002 | Gambetti | 53/210 |

FOREIGN PATENT DOCUMENTS

| | | |
|---|---|---|
| EP | 0 581 747 | 2/1994 |
| EP | 0 839 723 | 5/1998 |
| EP | 1 013 551 | 6/2000 |

* cited by examiner

*Primary Examiner*—John Sipos
*Assistant Examiner*—Louis Huynh
(74) *Attorney, Agent, or Firm*—Fay, Sharpe, Fagan, Minnich & McKee, LLP

(57) ABSTRACT

Groups of products are wrapped in heat-shrinkable film by equipment comprising a first surface along which products advance in a conveying direction, and a second surface on which the products are ordered into groups and wrapped in a sheet of film cut to a length suitable for the size of the group of products being wrapped and supplied by a feed unit positioned beneath and in close proximity to a slot separating the first surface from the second surface. The feed unit operates in conjunction with a wrapping unit incorporating at least one cross rail that serves to carry and guide the sheet of film, cantilevered from a single power driven arm located close to one side of the second surface, and an adjustment mechanism governing the position of the arm, such as will enable the rail to orbit through a first active trajectory above the second surface and a second return trajectory below the second surface, describing a curved path of which the distance from the second surface is variable and selectable according to the dimensions of the groups of products being wrapped.

18 Claims, 6 Drawing Sheets

EQUIPMENT FOR WRAPPING GROUPS OF PRODUCTS IN PLASTIC FILM

BACKGROUND OF THE INVENTION

The present invention relates to equipment for wrapping groups of products in plastic film, and particularly in heat-shrinkable film.

Such equipment is intended for use in packaging machines, and in particular, machines designed to handle items of cylindrical or prismatic geometry such as bottles, cans or the like.

Automatic machines of this type reflecting the current state of the art present a processing and infeed line on which bottles (the term "bottle" is used in the interests of simplicity, and does not imply the exclusion of other products exhibiting different shapes) are advanced through successive intermediate stations, where the selfsame bottles or other products are positioned and ordered into groups, and stations where the groups are enveloped or packaged in wrappings of plastic material.

The function of the intermediate positioning and ordering stations is to gather the single products into groups of predetermined number, which can vary according to the selected size and style of pack (in the case of bottles, for instance, the single group could consist in two rows of three bottles) and then to direct the selfsame products toward the aforementioned wrapping stations. Thereafter, the group leaves the wrapping station and passes along a conveying line to a final station at which the pack is completed, normally by applying a layer of heat-shrinkable film.

The wrapping station in question is equipped with a feed system by which the heat-shrinkable plastic film (used to form the wrappings) is decoiled from a roll and supplied continuously from a relative station located below the level of the conveying surface occupied by the products.

The film is supplied from the roll to a unit by which it is measured and cut into sheets of length sufficient to loop over the groups of products in a direction coinciding with the conveying direction and reach down to the conveying surface occupied by the selfsame products.

The conveying surface is surmounted by a special wrapping cage of which the function is to take up the film (onto cross rails carried between chains extending parallel on either side), as it emerges from a slot, and draw it over the groups in such a way that they can be wrapped during their movement along the conveying surface.

In practice, the film decoils along the conveying direction followed by the products and is wrapped around the group of products in such a manner that when the operation is completed, the ends of the wrapping sheet are overlapped whilst the sides of the group coinciding with the two vertical lateral faces of the pack are left exposed. The wrapping is drawn taut over the group of products by exploiting the heat-shrink properties of the plastic film, in a manner familiar to persons skilled in the art.

Attempts have been made, with machines having this type of structure, both to improve the output per unit of time and to reduce unproductive down times, for example as when changing from one size of pack to another: the changeover involves various operations affecting the drive systems (for example that of the decoiler and cutting station, to alter the length of the single sheet of film), and a number of mechanical adjustments, such as altering the height of the structure that carries the cross rails serving to lift and guide the film, effected by means of hand-operated linkages.

In this context the applicant has designed and implemented a solution for a feed and cut unit (disclosed in EP 839 723), positioned immediately below the slot through which the decoiling film is fed to the wrapping surface and comprising a pair of contrarotating rollers between which the film is interposed and gripped tangentially. A first of the two rollers is equipped with a radially projecting knife, whilst the second affords a radial groove positioned to accommodate the knife when a cut is made during each rotation, and presents a flat on the cylindrical surface designed to create a gap through which the film is able to pass freely.

The structure in question significantly improves the feeding and cutting action, rendering it almost continuous, and enables a swift size changeover as regards the length and preparation of the portion of film needed to wrap the group of products.

Nonetheless, there are still substantial problems with adaptation of the wrapping unit to a different size of pack, since the cage structure needs to be adjusted from both sides (by means of handwheels), altering the number and/or position of the cross rails by which the film is lifted and guided.

The object of the present invention, accordingly, is to overcome the drawbacks mentioned above by embodying equipment for wrapping groups of products in plastic film in such a way as to speed up and synchronize the operations of feeding and cutting the film, and rationalize size change operations insofar as they affect the unit by which the groups of products are wrapped, through the adoption of a simple, precise and compact structure.

SUMMARY OF THE INVENTION

The stated object is realized according to the present invention in equipment for wrapping groups of products in plastic film, comprising a first surface along which products are conveyed toward a second surface on which the selfsame products are formed into groups and wrapped each in a sheet of film by relative wrapping means, also a feed unit, by which the film is advanced and cut into sheets of length determined according to the dimensions of the group of products being wrapped, positioned beneath and in close proximity to a slot separating the first surface from the second surface.

Advantageously, the wrapping means comprise at least one cross rail carrying and guiding the sheet of film, supported at one end by a single power driven arm located in close proximity to one side of the second surface, and adjustment means acting at least on the power driven arm, such as will enable the cross rail to rotate through a first active trajectory passing above the second surface and a second return trajectory passing below the second surface, describing a curved path of which the distance from the second surface is variable and selectable according to the dimensions of the groups of products being wrapped.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
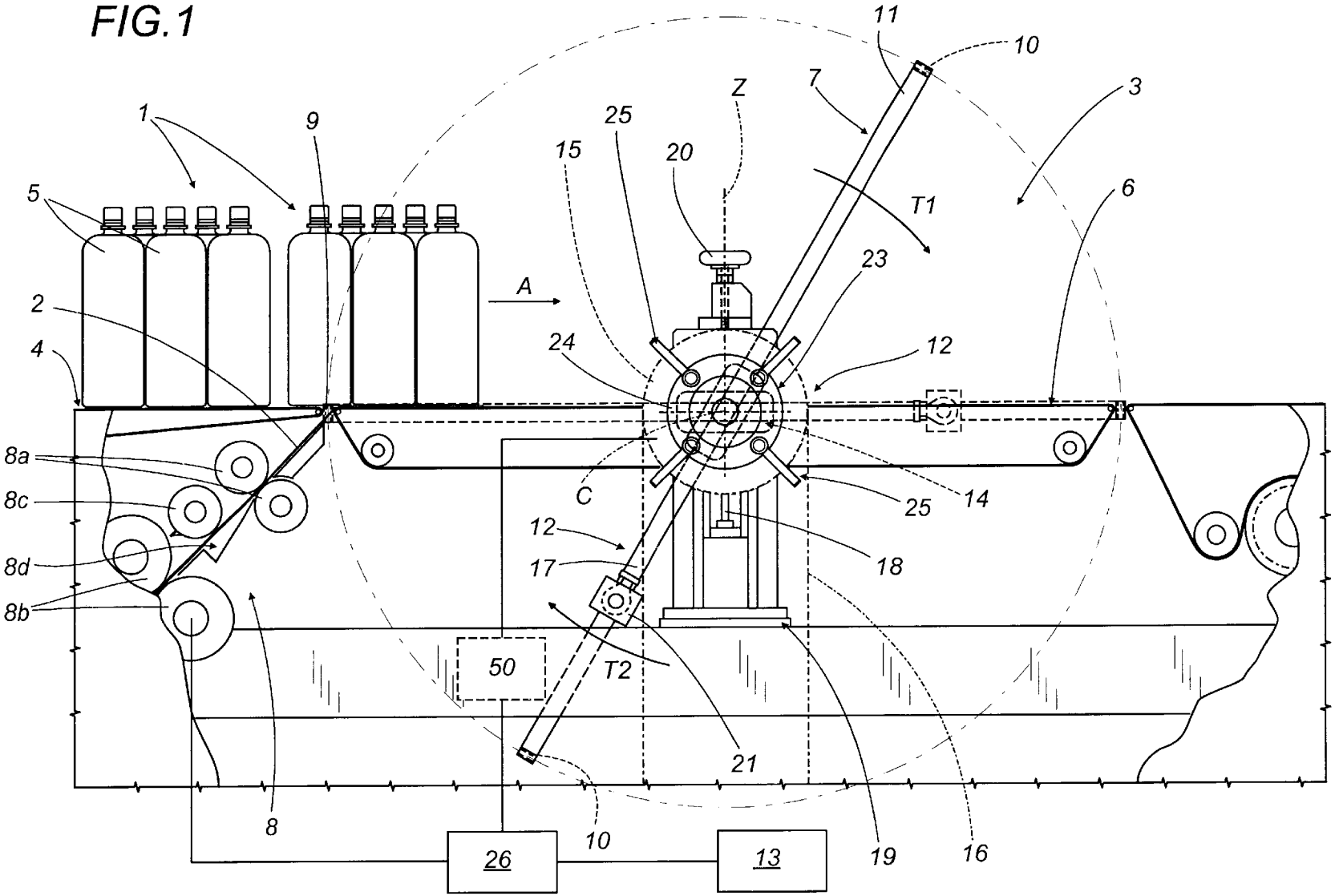
FIG. 1 illustrates a machine for wrapping groups of products in plastic film, furnished with the equipment according to the present invention, viewed in a front elevation with certain parts omitted to reveal others and shown in a first operating position.
Figure 2:
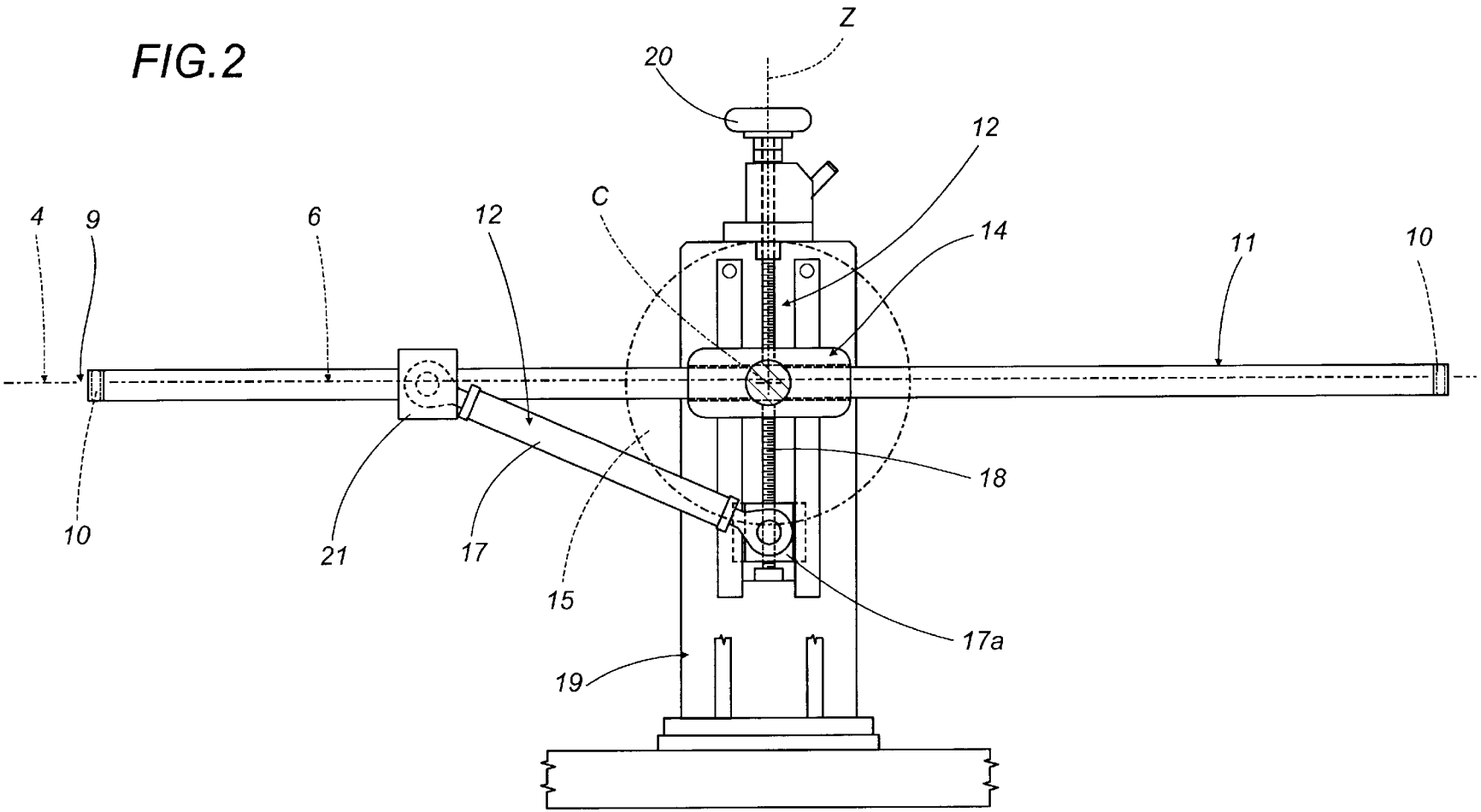
FIG. 2 shows the equipment of FIG. 1 viewed in a front elevation with certain parts omitted to reveal others.
Figure 3:
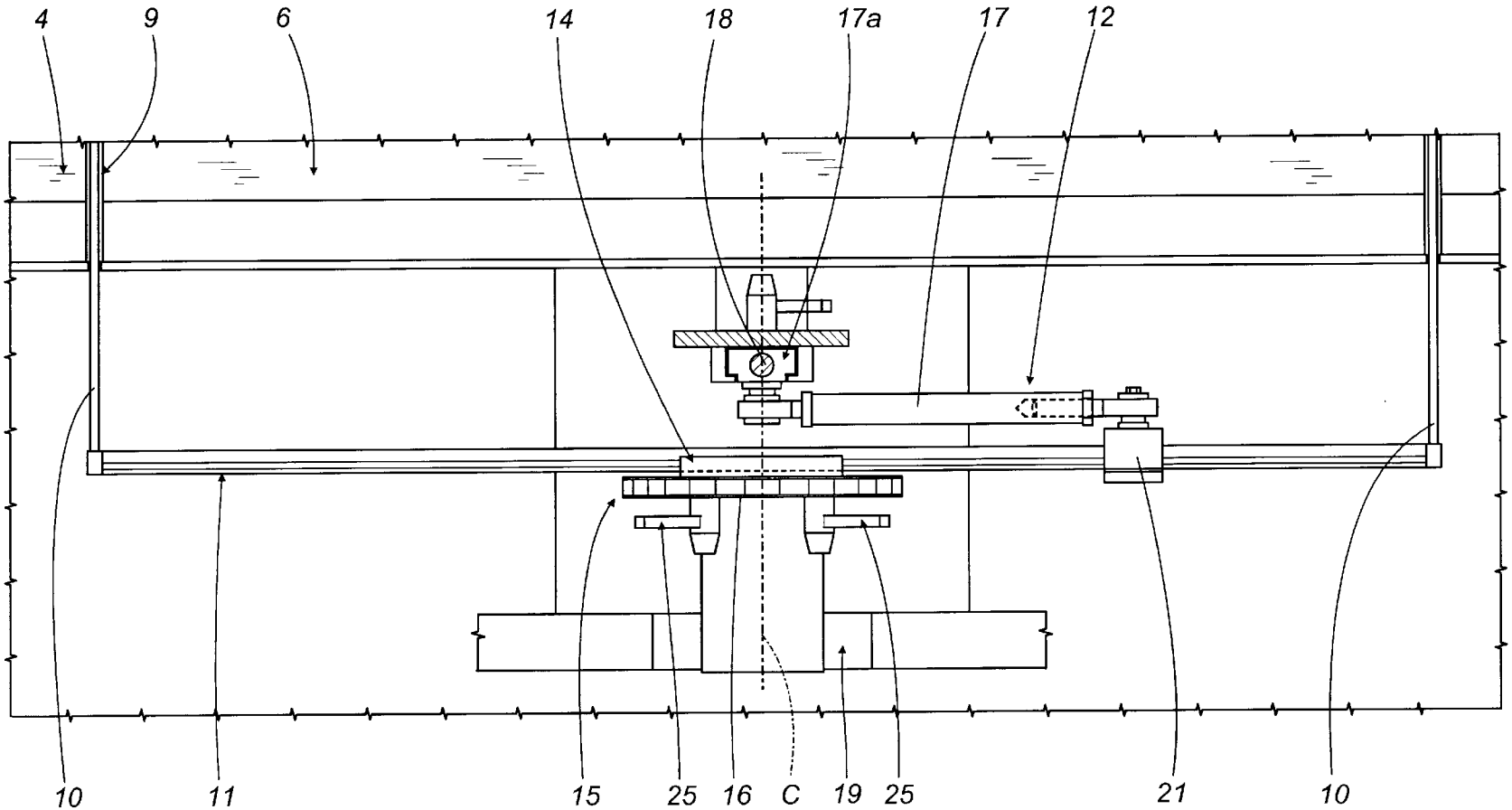
FIG. 3 shows the equipment of FIG. 2 viewed in plan from above with certain parts omitted to reveal others.

With reference to the figures of the accompanying drawings, and in particular FIGS. 1, 2 and 3, the equipment to which the invention relates is used to wrap groups 1 of products in film 2; this typically would be a heat-shrinkable plastic film albeit no limitation is implied.

The equipment is denoted 3 in its entirety and, as concerning the parts chiefly pertinent to the present disclosure, comprises a first conveying surface 4 on which products 5 advance following a direction indicated by the arrow denoted A; by way of example, such products might be bottles (which typically would be the tallest item wrappable) or cans or "tetrapak" type cartons containing foods (typically the shallowest items wrappable).

The products 5 in question are conveyed onto a second surface 6 on which the groups 1, formed by conventional means not shown in the drawings, are wrapped in predeterminable pack sizes with a sheet of the aforementioned plastic film 2 through the agency of relative means denoted 7. The wrapping appears with the two ends of the film clinging to the group 1 of products and with the vertical side faces of the group 1 exposed, as is the standard practice in the relative art field, whereupon the pack advances to a station equipped with an oven internally of which the film is caused by virtue of its heat-shrinkable properties to tighten around the group and complete the pack.

Observing FIG. 1, the equipment 3 comprises a feed unit 8, by which the film 2 is advanced and cut into sheets of length determined according to the dimensions of the group 1 of products being wrapped, operating in conjunction with wrapping means 7 that include at least one cross rail 10 designed to take up and guide the sheet of film 2 as it emerges from a slot 9 separating the first and second surfaces. The cross rail 10 in question is cantilevered from one end of a single motorized arm 11.

The feed unit 8 is located beneath and in close proximity to the slot 9 separating the first and second surfaces 4 and 6, through which the film 2 is directed up and over and into the path of the advancing group 1 of products.

The unit 8 comprises two pairs of pinch rolls 8*a* and 8*b* by which the film 2 is gripped and advanced, and, located between the two pairs of pinch rolls, a rotary cutter 8*c* offered to a flat surface 8*d* supporting the advancing film 2, by which the film is divided into discrete lengths. The unit 8 is set in motion by a drive system, not illustrated in the drawings, and interlocked to a programmable control unit 26 in such a way as to determine both the rate at which the film 2 is fed to the second conveying surface 6, and the length to which the film must be cut in order to suit the size of the products being wrapped (explained in due course).

Still with reference to FIGS. 1, 2 and 3, the aforementioned arm 11 is positioned on one side of the second surface 6 and subject to the action of adjustment means 12 such as will allow the cross rail 10 to rotate through a first active trajectory denoted T1, extending above the second surface 6, and a second return trajectory T2 extending below the second surface 6. Both of the trajectories T1 and T2 in question describe a curved path, passing at a distance from the second surface 6 that is variable and selectable according to the dimensions of the group 1 of products being wrapped.

In the example illustrated, the single arm 11 carries preferably two cross rails 10 attached one to each end of the selfsame arm 11.

The two cross rails 10 each present a rounded and flattened section and are cantilevered rigidly from the arm 11.

As discernible in FIGS. 1 to 3, one part of the adjustment means 12 is associated with the single arm 11 and serves to position it along a vertical axis Z intersecting the axis C of rotation of the selfsame arm 11.

Another part of the adjustment means 12 is joined to the drive 13 operating the arm 11 and can thus act on the arm in such a way as to vary the timing of the passage of the cross rails 10 through the slot .9 relative to the film 2 as it approaches the selfsame slot. In short, the position of the single cross rail 10 in relation to the length of emerging film 2 can be advanced or retarded according to the size of pack determined by the dimensions of the group 1 of products.

Structurally, the arm 11 is constrained slidably within a guide 14 mounted rigidly to a sprocket 15 centered on the axis C of rotation of the arm 11. The sprocket 15 is connected to the drive 13 by way of a chain 16 and able thus to set the arm 11 in rotation relative to the second surface 6.

Regarding the adjustment along the aforementioned axis Z, the corresponding part of the adjustment means 12 consists in a link rod 17 hinged at one end to a portion of the single arm 11 at a point offset from the axis C of rotation of the selfsame arm 11; the opposite, fulcrum end of the rod 17 is anchored by way of a lead nut 17*a* to a vertically disposed lead screw 18 associated with a fixed frame 19 of the equipment.

The lead screw 18 in turn is coupled to control means 20 such as will allow of repositioning the end of the rod 17 relative to the second surface 6 by moving it along the vertical axis Z in either direction, and thus defining the two active and return trajectories T1 and T2 within a prescribed range according to the pack size determined by the dimensions of the group 1 of products (as will be described in due course).

The rod 17 is hinged to a block 21 associated permanently with the arm 11 and furnished with means 22 by which the selfsame block 21 can be locked to or released from the arm 11, so that the rod 17 is positionable in relation to the arm by operating the vertical screw adjustment mechanism mentioned above, and thus causing the block 21 to slide along the arm 11. In practice, the rod 17 must be released from the arm 11 when adjusting its height on the vertical lead screw, to ensure that the positional relationship between the arm and the second surface 6 is not disturbed.

Figure 6:
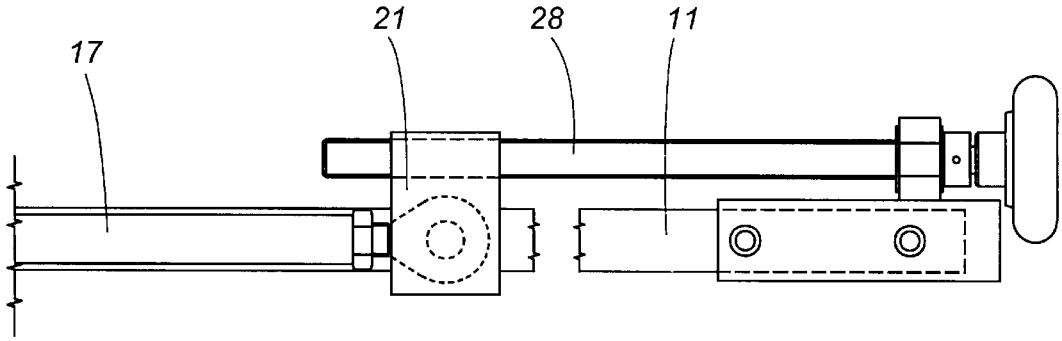
FIGS. 6 and 7 show an alternative embodiment of the equipment disclosed, in elevation and in plan from above, respectively.
Figure 7:
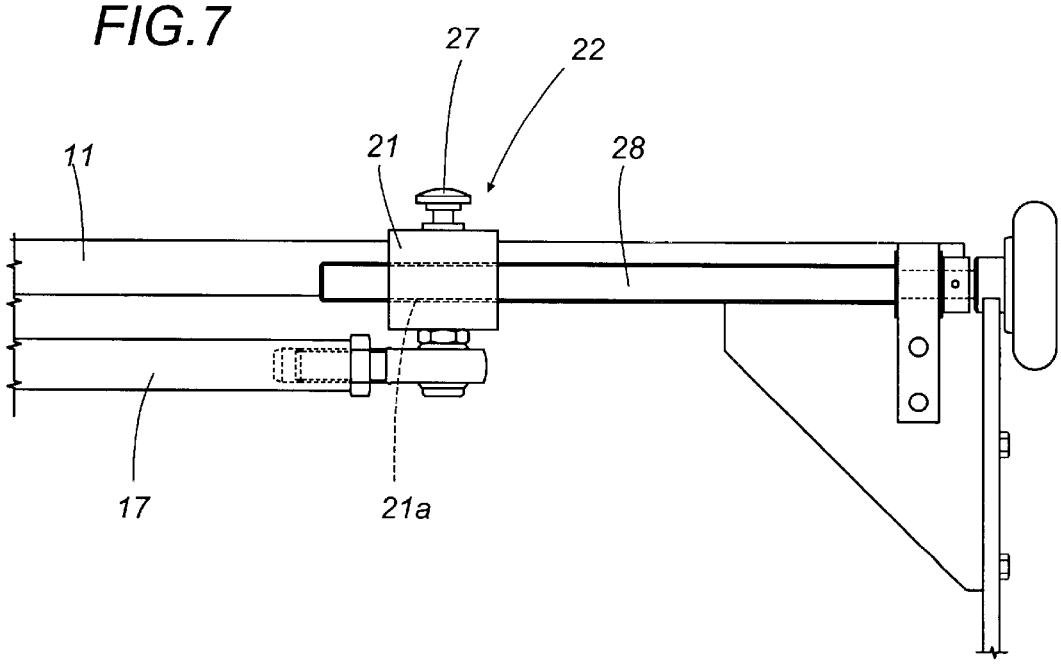

In the example of FIGS. 6 and 7, the means 22 of locking/releasing the link rod 17 comprise a handle 27 with which the block 21 can be clamped to the arm 11, by friction, and freed from the arm. Also anchored to the block 21 is a threaded second rod 28, occupying a socket denoted 21*a* and associated with the end of the arm 11, such as will allow of tensioning the link rod 17 and effecting a final adjustment after the height adjustment has been made at the fulcrum end of the rod 17.

Referring again to FIGS. 1 and 3, the part of the adjustment means 12 remote from the block 21 also comprises the sprocket 15, which is composed of a hollow ring 23 occupied by a freely rotatable circular element 24 carrying the aforementioned guide 14, and mounted to the fixed frame 19.

Also forming part of the adjustment means 12 are lock-and-release means denoted 25 operating between the sprocket 15 and the circular element 24 and in such a way as will enable the arm 11, constrained by the guide 14, to be set with the cross rails 10 disposed initially at a selectable angular distance from a horizontal plane coinciding with the second surface 6.

The drive 13 is programmed to parameters which include that of the pack size, so that the arm 11 can maintain a constant speed of rotation, whilst the speed of the feed unit 8, or rather the decoil rate of the film 2, is dependent both on the speed of rotation of the arm 11 and on the aforementioned active trajectory T1 described by the arm.

The operation of the equipment structured in the manner thus described is as follows, departing from the start of a cycle with a new group of products.

Figure 4:
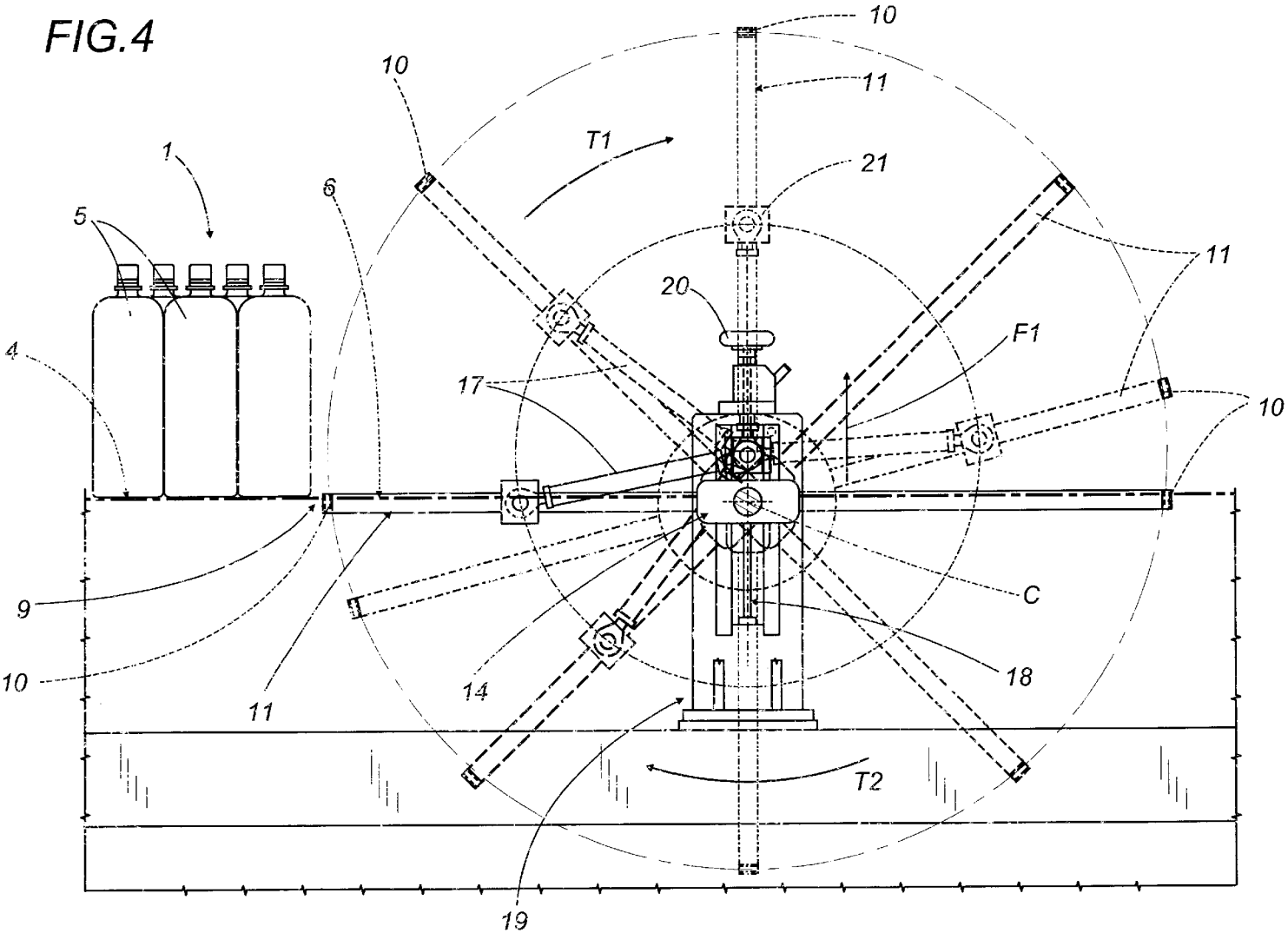
FIG. 4 illustrates the equipment of FIGS. 1, 2 and 3 in a first sequence of wrapping movements completed by an arm operating on a first group of products, viewed schematically in a front elevation with certain parts omitted to reveal others.

The machine operator sets the adjustment means 12 of the equipment according to the dimensions of the group of products being wrapped; accordingly, if the products are groups of bottles (as indicated in FIGS. 1 and 4) and appreciably tall, the end of the link rod 17 anchored to the lead screw 18 will be positioned by the operator above the level of the second surface 6 (arrow F1, FIG. 4), so as to elevate the end of the selfsame rod 17 secured to the arm 11.

In addition, the adjustment means 25 can be used by the operator to set the starting position of the cross rails 10 in relation to the slot 9, and the control unit 26 governing the feed unit 8 can be programmed automatically to vary the rate at which the film 2 decoils, by way of previously determined algorithms, according to the speed of rotation of the arm 11, and according to the trajectories and positions described and assumed by the arm 11 when in rotation, so as to accommodate the dimensions of the group of products; in the case of bottles, an abundant quantity of film 2 must be decoiled at a fast rate, given the size of the pack.

The rotation of the arm 11, and consequently the orbit of the cross rails 10, is governed by the link rod 17, and more exactly, for each sector of angular distance covered by the arm 11 above the level of the second surface 6, the vertex of an angle compassed between the arm 11 and the rod 17 will describe a predetermined active trajectory T1 as the rod tends to elevate the arm 11 (during the trajectory T1) by reason of its fulcrum end being located above the second surface 6 and higher than the axis C of rotation of the arm 11. The elevation of the arm, hence also of the cross rails 10, is brought about thanks to the sliding association of the arm 11 and the guide 14 and has the effect of generating a higher active trajectory T1 for the purposes of wrapping the film 2, and a lower return trajectory T2, considered in relation to the second surface 6.

The two cross rails 10 lie equidistant from the axis C of rotation at the moment of passing singly through the slot 9 or at all events through the spaces separating the second surface 6 from other stations of the machine.

Figure 5:
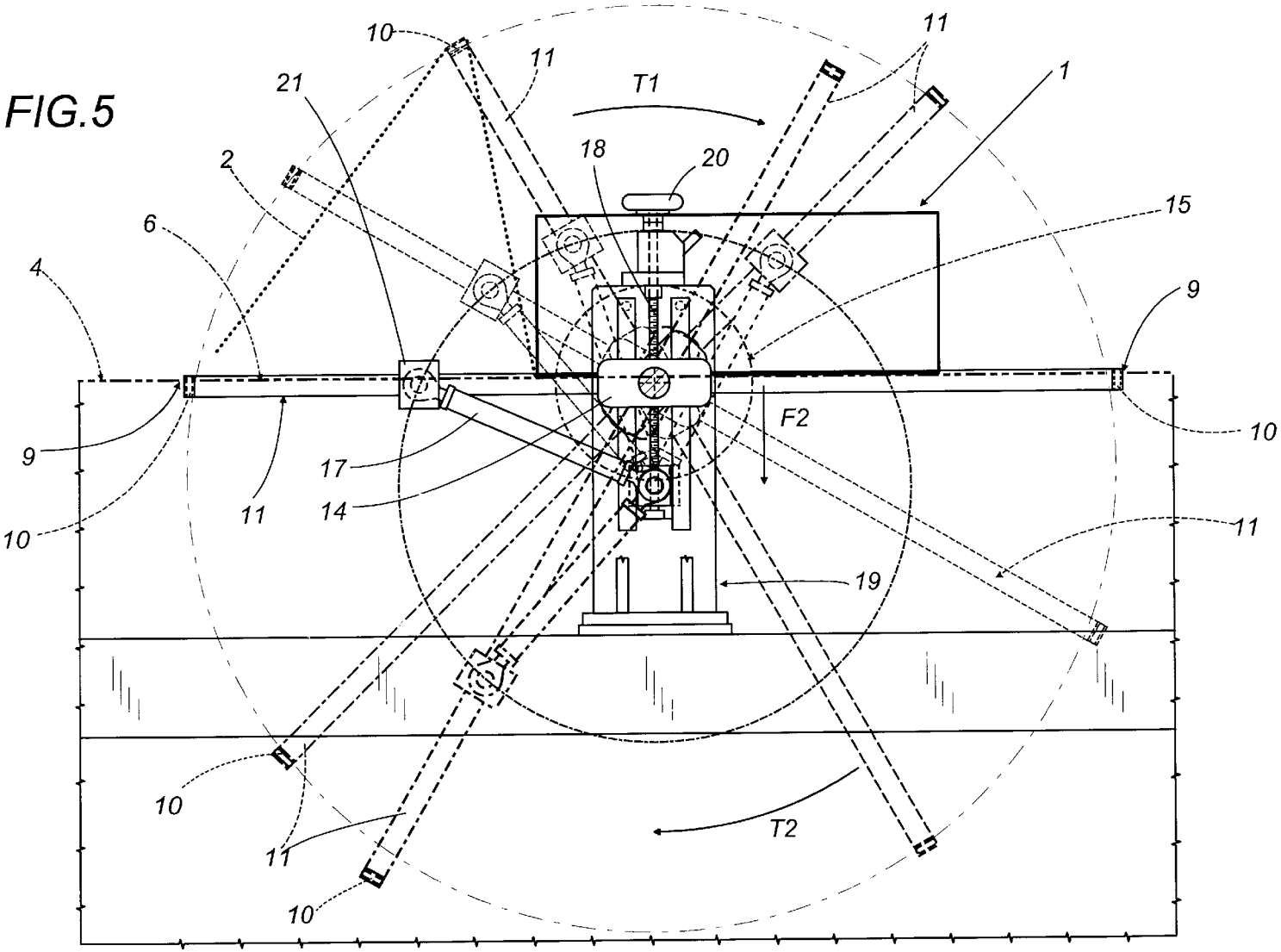
FIG. 5 illustrates the equipment of FIGS. 1, 2, and 3 in a second sequence of wrapping movements completed by an arm operating on a second group of products, viewed schematically in a front elevation with certain parts omitted to reveal others.

FIG. 5, by contrast, illustrates the opposite situation to that of FIG. 4, that is, where the products being wrapped are shallow or squat.

In this instance the fulcrum pivot of the rod 17 must be positioned below the level of the second surface 6 and lower than the axis C of rotation of the arm 11 (see arrow F2); this has the effect of varying the geometrical configuration so that the active trajectory T1 described when wrapping the film 2 is brought nearer to the second surface 6, whereas the return trajectory T2 described by the cross rails 10 will be distanced from the selfsame surface 6, again by the action of the rod 17. In this configuration, accordingly, the film 2 can be positioned markedly close to the group of products advancing along the second surface 6 during the wrapping pass.

Similarly, the feed unit 8 will be programmed via the control unit 26 to decoil and cut the film as appropriate for the type of product being wrapped, in this instance requiring a feed rate slower than the angular velocity of the arm 11 and using less film than in the example described previously.

A further improvement of the equipment described thus far might be to provide the arm 11 with a variable speed drive (brushless motor), indicated by a phantom line block denoted 50 in FIG. 1, interlocked to the control unit 26 and utilized to vary the speed of rotation of the arm 11 in given operating situations, to the end of increasing the overall productivity of the equipment and widening the range of products that can be wrapped.

The object stated at the outset is thus realized in full with the equipment disclosed, thanks to a combination of elements forming a structure that is extremely simple as well as being adjustable by way of a few simple operations, swiftly and safely, to accommodate different pack sizes.

With the wrapping unit located on one side of the machine only, and the decoiling and cutting unit positioned as illustrated, size-sensitive working parts can be adjusted in a single operation while maintaining the necessary quality and precision of the wrapping action.

The times taken to effect a size changeover are therefore drastically reduced, and a machine fitted with the equipment disclosed acquires a high level of flexibility in production, accommodating a broad variety of product types differing in size one from another.

What is claimed is:

1. An apparatus for wrapping groups of products in film, comprising:

a first surface for advancing products along a predetermined conveying direction;

a second surface for forming the products received from the first surface into a group of products to be wrapped;

a feed unit positioned beneath and in close proximity to a slot separating the first and second surfaces for advancing a film through the slot and cutting the film into sheets of length determined according to dimensions of the group of products being wrapped; and a wrapping means comprising at least one cross rail for carrying and guiding the sheet of film, a single power driven arm disposed on one side of the second surface for rotating about a rotational axis and supporting the at least one cross rail at an end thereof, and adjustment means acting on the single power driven arm for enabling the at least one cross rail to rotate through the slot and describe a first active trajectory above the second surface and a second return trajectory below the second surface, wherein the distances of the first and second trajectories are variably selectable according to the dimensions of the group of products.

2. The apparatus as in claim 1, further comprising control means for controlling the feed unit to advance and cut the film into sheets according to the size of the group of products being wrapped, the speed of the single power driven arm and the geometry of the first trajectory.

3. The apparatus as in claim 2, wherein the feed unit comprises two pairs of pinch rolls for gripping and advancing the film, a rotary cutter disposed between the pairs of pinch rolls and cooperating with a film supporting surface for cutting the film into discrete lengths.

4. The apparatus as in claim 1, wherein the single power driven arm carries at least one cantilevered cross rail.

5. The apparatus as in claim 1, wherein the single power driven arm carries at least a pair of cantilevered cross rails associated one with each end of the arm.

6. The apparatus as in claim 1, wherein a part of the adjustment means is associated with the single power driven arm and serves to determine the position of the arm along a vertical axis intersecting the axis of rotation of the arm.

7. The apparatus as in claim 6, wherein the single power driven arm is constrained slidably within a guide rigidly associated with a sprocket, centered on the axis of rotation of the arm and connected by way of a relative chain to a drive in such a way that the arm can be set in rotation relative to the second surface.

8. The apparatus as in claim 6, wherein a part of the adjustment means comprises a link rod having a hinged end hinged to a portion of the single power driven arm at a point offset from the axis of rotation of the arm and an opposite fulcrum end pivotably anchored to a vertically disposed lead screw associated with a fixed frame of the apparatus and coupled to control means for repositioning the fulcrum end of the rod in one direction and the other along the vertical axis, relative to the second surface, in such a way that the active and return trajectories described by the at least one cross rail can be set at predetermined distances from the second surface according to the dimensions of the group of products.

9. The apparatus as in claim 1, wherein a part of the adjustment means is connected to a drive system of the single power driven arm to control the arm in such a way that the position of the at least one cross rail when passing through the slot can be advanced or retarded with respect to a predetermined length of film fed simultaneously through the slot.

10. The apparatus as in claim 9, wherein a part of the adjustment means includes a sprocket comprising a hollow ring mounted to a fixed frame, a freely rotatable circular element carrying a guide for slidably constraining the single power driven arm, and lock and release means operating between the hollow ring and the circular element for allowing the single power driven arm to be set with the at least one cross rail disposed initially at a selected angular distance from a horizontal plane coinciding with the second surface.

11. The apparatus as in claim 1, wherein the single power driven arm is constrained slidably within a guide rigidly associated with a sprocket, centered on the axis of rotation of the arm and connected by way of a relative chain to a drive in such a way that the arm can be set in rotation relative to the second surface.

12. The apparatus as claim 1, wherein the at least one cross rail presents a rounded flattened profile when viewed in section and is cantilevered rigidly from the single power driven arm.

13. The apparatus as in claim 1, wherein a part of the adjustment means comprises a link rod having a hinged end hinged to a portion of the single power driven arm at a point offset from the axis of rotation of the arm an opposite fulcrum end pivotably anchored to a vertically disposed lead screw associated with a fixed frame of the apparatus and coupled to control means for repositioning the fulcrum end of the rod in one direction and the other along the vertical axis, relative to the second surface, in such a way that the active and return trajectories described by the at least one cross rail can be set at predetermined distances from the second surface according to the dimensions of the group of products.

14. The apparatus as in claim 13, wherein the one end of the link rod is hinged to a block anchored to the single power driven arm and furnished with means by which the block can be locked to and released from the arm, so as to allow of repositioning the rod slidably along the arm whenever the fulcrum end of the rod is repositioned along the vertical axis.

15. The apparatus as in claim 14, wherein the means for locking and releasing the link rod comprise a handle for clamping the block by friction to and releasing the block from the single power driven arm, and wherein the block is coupled to a threaded rod mounted at the corresponding end of the arm for tensioning and effecting a final adjustment of the link rod following a height adjustment made to the fulcrum end of the link rod.

16. The apparatus as in claim 1, further comprising a drive for driving the single power driven arm and control means for controlling the drive and the feed unit to synchronize and vary the feed and cut rate of the film and the speed of the single power driven arm according to the dimensions of the group of products being wrapped.

17. The apparatus as in claim 11, wherein the sprocket comprising a hollow ring mounted to a fixed frame, a freely rotatable circular element carrying the guide for slidably constraining the single power driven arm, and lock and release means operating between the hollow ring and the circular element for allowing the single power driven arm to be set with the at least one cross rail disposed initially at a selected angular distance from a horizontal plane coinciding with the second surface.

18. The apparatus as in claim 1, wherein the feed unit comprises two pairs of pinch rolls for gripping and advancing the film, a rotary cutter disposed between the pairs of pinch rolls and cooperating with a film supporting surface for cutting the film into discrete lengths.

* * * * *